US006237673B1

(12) United States Patent
Kato et al.

(10) Patent No.: US 6,237,673 B1
(45) Date of Patent: May 29, 2001

(54) STRIP CASTING APPARATUS

(75) Inventors: Heiji Kato, Yokosuka (JP); John Andrew Fish, Woonona; Wayne Russell, Wollongong, both of (AU)

(73) Assignees: Ishikawajima-Harima Heavy Industries Company Limited, Tokyo (JP); BHP Steel (JLA) Pty Ltd, Sydney (AU)

( * ) Notice: Subject to any disclaimer, the term of this patent is extended or adjusted under 35 U.S.C. 154(b) by 0 days.

(21) Appl. No.: 09/330,023

(22) Filed: Jun. 11, 1999

(30) Foreign Application Priority Data

Jun. 12, 1998 (AU) ..... PP4067

(51) Int. Cl.[7] ..... B22D 11/06
(52) U.S. Cl. ..... 164/428; 164/480
(58) Field of Search ..... 164/428, 480

(56) References Cited

U.S. PATENT DOCUMENTS 5,810,070 * 9/1998 Osada et al. ..... 164/480

* cited by examiner

*Primary Examiner*—Kuang Y. Lin
(74) *Attorney, Agent, or Firm*—Miles & Stockbridge P.C.; John C. Kerins

(57) ABSTRACT

Twin roll strip casting apparatus in which a pair of pool confining side plates (56) engage end surfaces of casting rolls (16) to form side confining closures for the pool. Plates (56) are mounted in side plate holders (82) connected to horizontally acting thrusters (83) which apply inward closure forces to the side plates (56). Thrusters (83) are mounted on a pair of carriages (101) disposed one at each end of the casting roll assembly and movable toward and away from one another to enable the spacing between them to be adjusted so that the carriages (101) can be preset before a casting operation to suit the width of the casting rolls (16). Carriages (101) are mounted on a central frame structure (103) which sits over the casting rolls (16).

21 Claims, 6 Drawing Sheets

140
142
103
18
145
144
107
105
128
141
130
129
120
120
101
83
121
43
42
143
56
126
82
16
128

STRIP CASTING APPARATUS

BACKGROUND OF THE INVENTION

This invention relates to the casting of metal strip. It has particular application to the casting of metal strip by continuous casting in a twin roll caster.

In a twin roll caster molten metal is introduced between a pair of contract-rotated horizontal casting rolls which are cooled so that metal shells solidify on the moving roll surfaces and are brought together at the nip between them to produce a solidified strip product delivered downwardly from the nip between the rolls. The term "nip" is used herein to refer to the general region at which the rolls are closest together. The molten metal may be poured from a ladle into a smaller vessel or series of smaller vessels from which it flows through a metal delivery nozzle located above the nip so as to direct it into the nip between the rolls, so forming a casting pool of molten metal supported on the casting surfaces of the rolls immediately above the nip and extending along the length of the nip. This casting pool is usually confined between side plates or dams held in sliding engagement with end surfaces of the rolls so as to dam the two ends of the casting pool against outflow.

The setting up and adjustment of the casting rolls and the metal delivery and pool confinement components in a twin roll caster is a significant problem. The rolls must be accurately set to properly define an appropriate width for the nip, generally the order of only a few millimeters, and there must also be some means for allowing at least one of the rolls to move outwardly against a biasing force to accommodate fluctuations in strip thickness particularly during start up. The rolls may need to be changed between casts so as to allow a different width of strip to be cast and the rolls must be replaced if the casting surfaces are in any way damaged or deteriorate during casting. If the rolls have to be changed in sit-up, a significant amount of potential casting time is lost waiting for the casting components and the area surrounding them to cool. The new set of rolls, once in place, have to be calibrated prior to casting so that the nip width can be pre-set. When casting ferrous metals, it is necessary to preheat the refractory components of the metal delivery and pool confinement means to very high temperatures before casting commences. For these reasons it has been proposed to build twin roll casters with demonstrable components so that the rolls and preheated refractory components can be rapidly brought together into an operative assembly and casting started before the preheated components cool significantly. One example of a caster with moveable rolls and refractory components is disclosed in our Australian Patents 631728 and 637548 and corresponding U.S. Pat. Nos. 5,184,668 and 5,277,243.

The invention described in our Australian Patent Application 84244/98 enables a twin roll strip caster to be built with a modular construction in which the casting rolls are installed in a moveable module readily moveable into and out of the machine and in which the rolls can be accurately set up in the module so that the nip is preset and will be located accurately in the machine when the module is installed. This enables roll sets to be set up in advance in replacement modules for rapid changing of rolls between casts. However, proper positioning of the pool confinement side dams and proper adjustment of the mechanisms to apply the side dams to the ends of the rolls remains a problem, particularly if the size of the rolls is changed to allow a different width of strip to be cast.

A change of strip width requires a similar change in the width of the metal delivery nozzle and there must be an appropriate repositioning of the supports for the nozzle. There will generally also be a need to reposition other components which are dependent on the width of the casting pool, for example, any sealing elements which seal the casting pool chamber and any pool level sensor or camera installed at an end of the pool to examine the pool conditions during casting.

By the present invention the side dams and side dam applicators are mounted on a pair of carriages which can be moved in and out and preset to positions appropriate to the width of the casting pool. The side dams can thus be rapidly repositioned when the rolls are changed for any reason, for example, for a change of width of the strip to be cast. Moreover, the carriages can also be used to support other components which need to be adjusted according to the width of the casting pool, for example, nozzle end supports, casting pool seals and camera mountings.

SUMMARY OF THE INVENTION

According to the invention there is provided apparatus for continuously casting metal strip comprising a pair of parallel casting rolls forming a nip between them; metal delivery means to deliver molten metal into the nip between the rolls to form a casting pool of molten metal supported on casting roll surfaces immediately above the nip; a pair of pool side plates to engage end surfaces of the rolls whereby to form side confining closures for the casting pool; a pair of side plate holders to hold the side plates; a pair of generally horizontally acting thrusters connected to the side plate holders and actuable to apply opposing inward closure forces to the side plates; and roll drive means to drive the casting rolls in counter-rotational directions to produce a solidified strip of metal delivered downwardly from the nip; wherein the thrusters are mounted on a pair of carriages disposed one at each end of the casting roll assembly and moveable toward and away from one another to enable the spacing between them to be adjusted so that the carriages can be preset before a casting operation to suit the width of the casting rolls and to allow them to serve as reaction abutments against which the thrusters react to apply the inward closure forces to the side plates and wherein further both carriages are mounted on a central frame structure which sits over the casting rolls.

Preferably, the metal delivery means comprises an elongate metal delivery nozzle disposed immediately above the nip and a metal distribution vessel to distribute metal into the nozzle. The metal delivery nozzle may be composed of two or more pieces disposed end to end.

Preferably further, the frame structure provides a central nozzle locating support for the metal delivery nozzle.

Preferably further, there is a carriage drive means acting between the frame and the carriages to move the carriages toward and away from one another.

Preferably further, the carriage drive means is operable to set the carriages at any one of a plurality of preset spacings in which they are set generally equidistant from the central nozzle locating support.

Preferably further, the carriages are provided with nozzle outer end supports to support outer ends of the nozzle at locations the spacing of which is determined by the preset spacing of the carriages.

Preferably too, the nozzle outer end supports are mounted on the carriages so as to be equidistant from the centre nozzle locating support when the carriages are in any of their preset spacings.

The carriages may also be provided with sealing means to engage the metal delivery means so as to provide a sealed casting pool chamber above the casting pool. Where the metal delivery means comprises a metal distribution vessel disposed above a delivery nozzle, the sealing means may engage end parts of the distribution vessel.

At least one of the carriages may also be provided with a camera mounting for mounting a camera to observe the casting pool during casting whereby to maintain a generally constant relationship between the camera position and the respective pool confining side dam.

Preferably, the camera mounting is positioned directly above the respective side dam structure.

BRIEF DESCRIPTION OF DRAWINGS

In order that the invention may be more fully explained, one particular embodiment will be described in some detail with reference to the accompanying drawings in which.

DESCRIPTION OF PREFERRED EMBODIMENT

Figure 1:
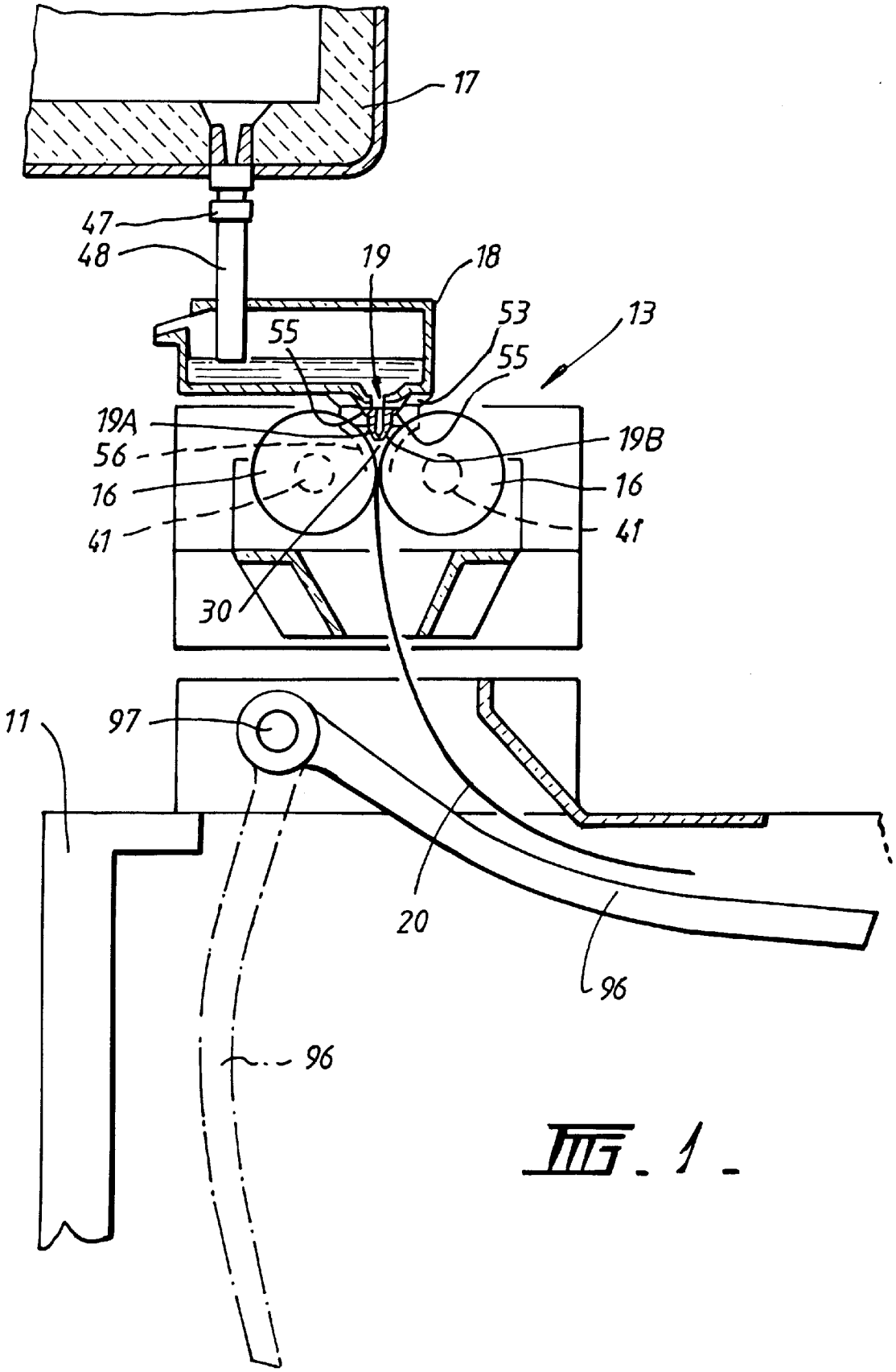
FIG. 1 is a vertical cross section through a strip caster constructed in accordance with the present invention.
Figure 2A:
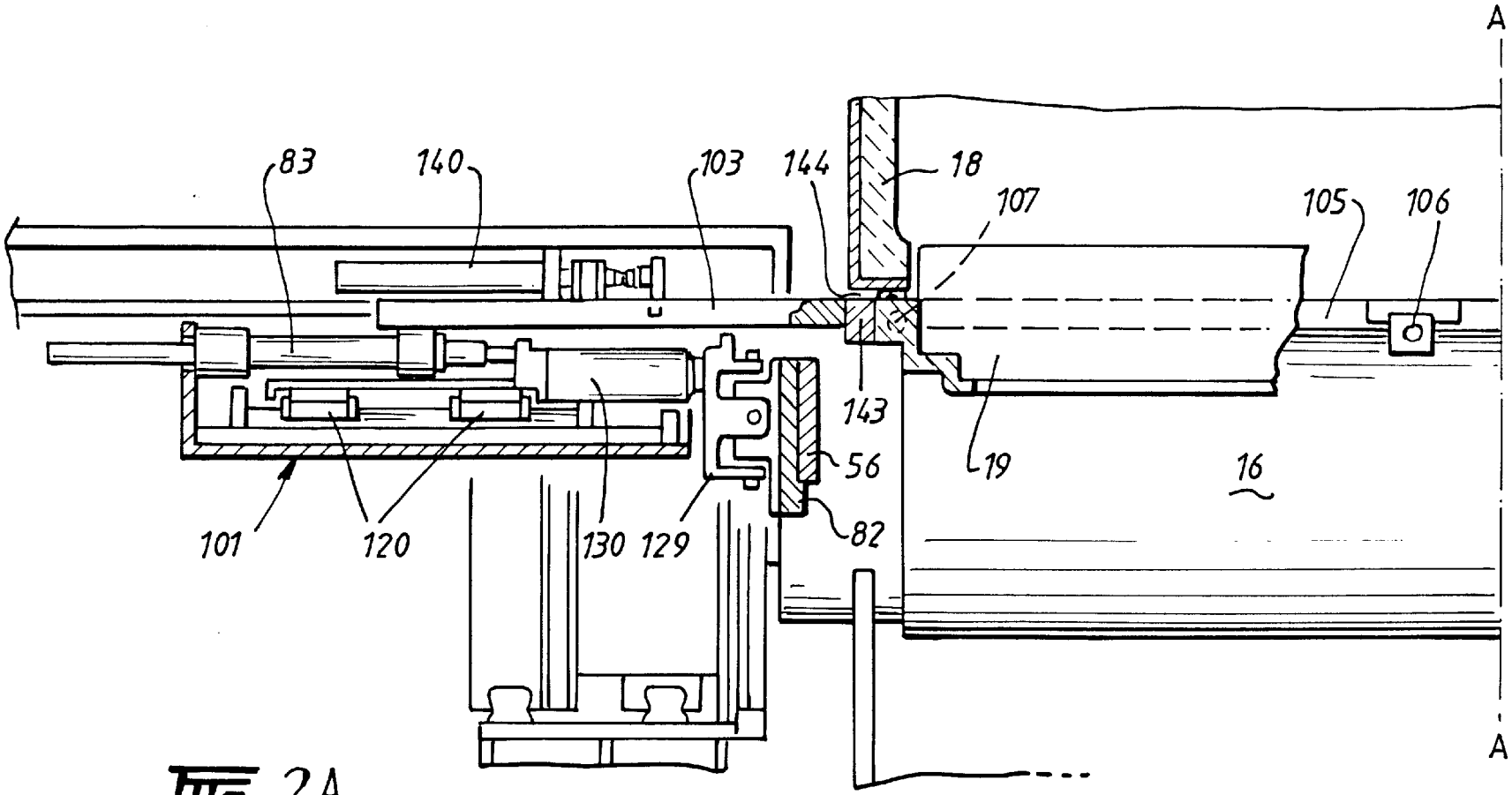
FIGS. 2A and 2B join on the line A—A to form a longitudinal cross section through important parts of the caster.
Figure 2B:
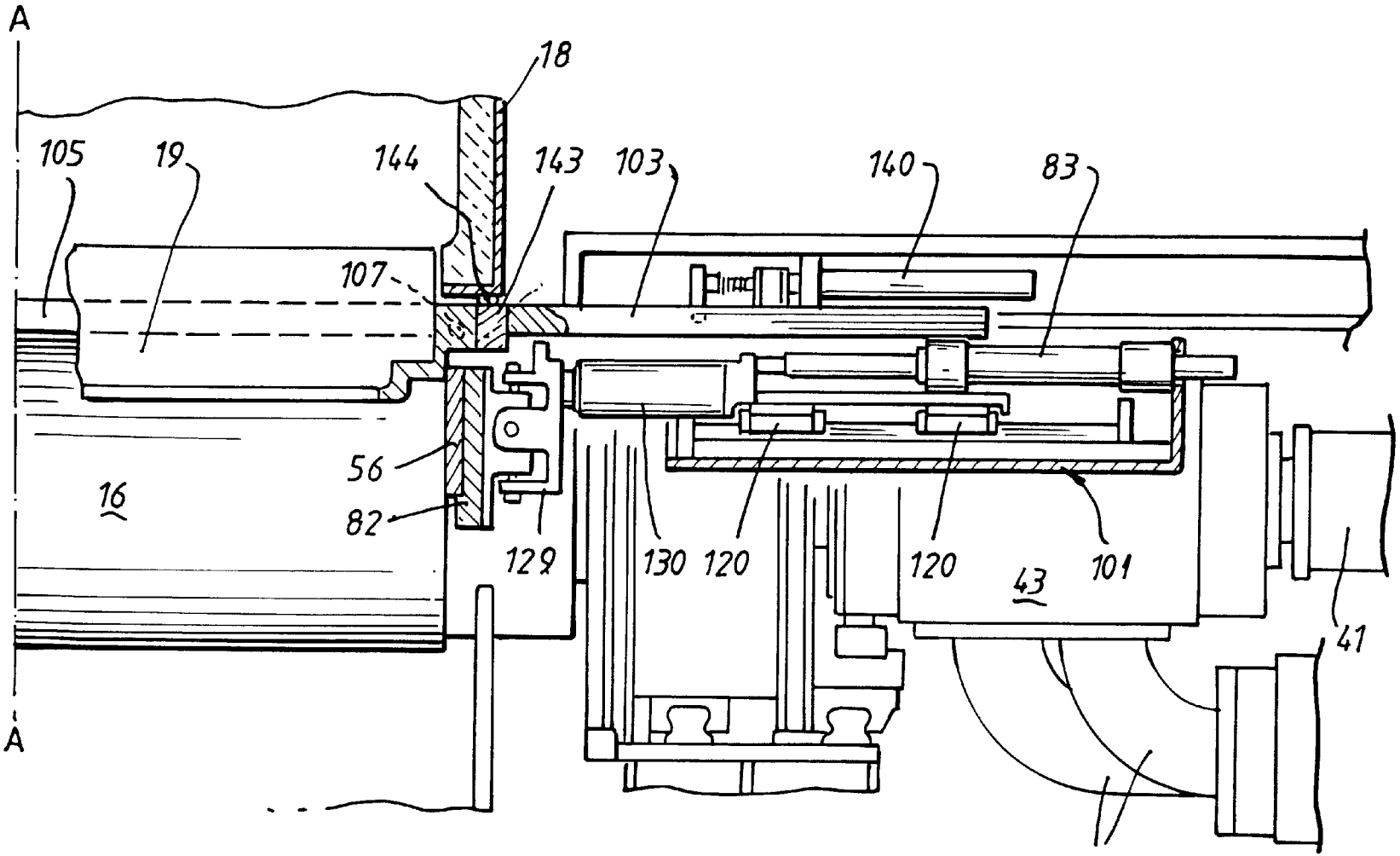
Figure 3:
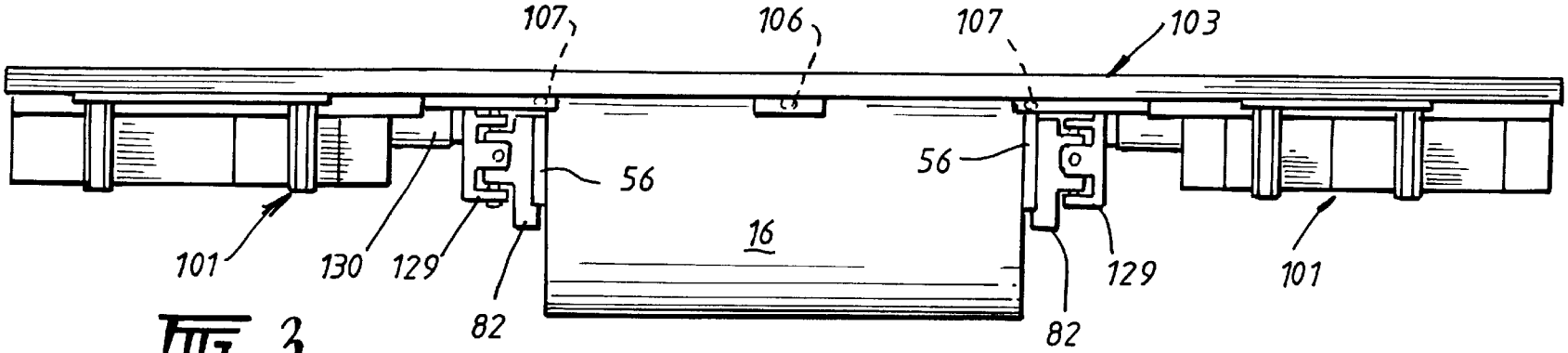
FIG. 3 is a side elevation of important parts of the caster arranged in accordance with the present invention.
Figure 4:
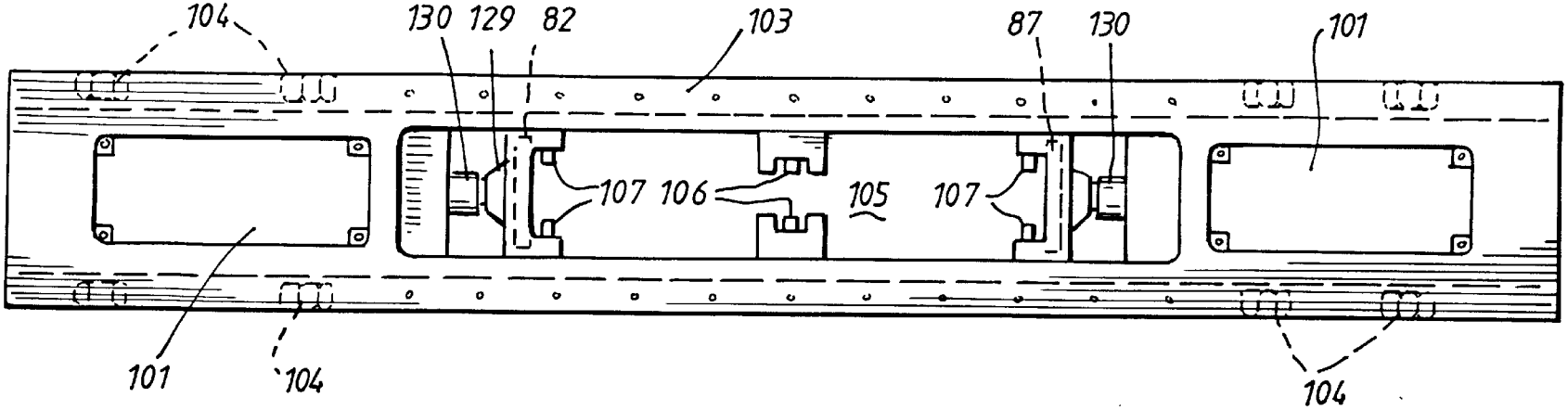
FIG. 4 is a plan view of the components shown in FIG. 3.
Figure 5:
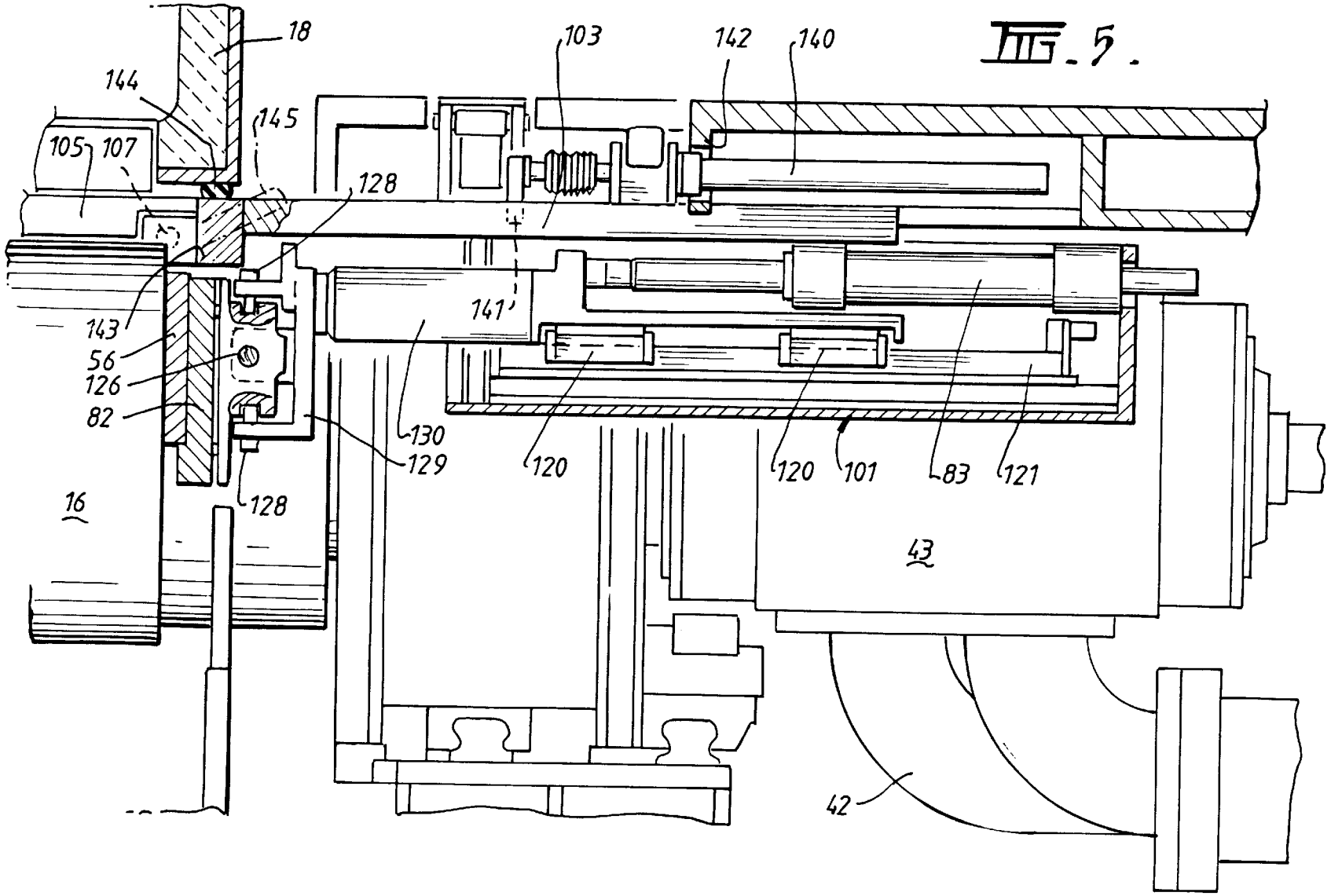
FIG. 5 is an enlarged vertical cross section through critical caster components at one end of the caster.
Figure 6:
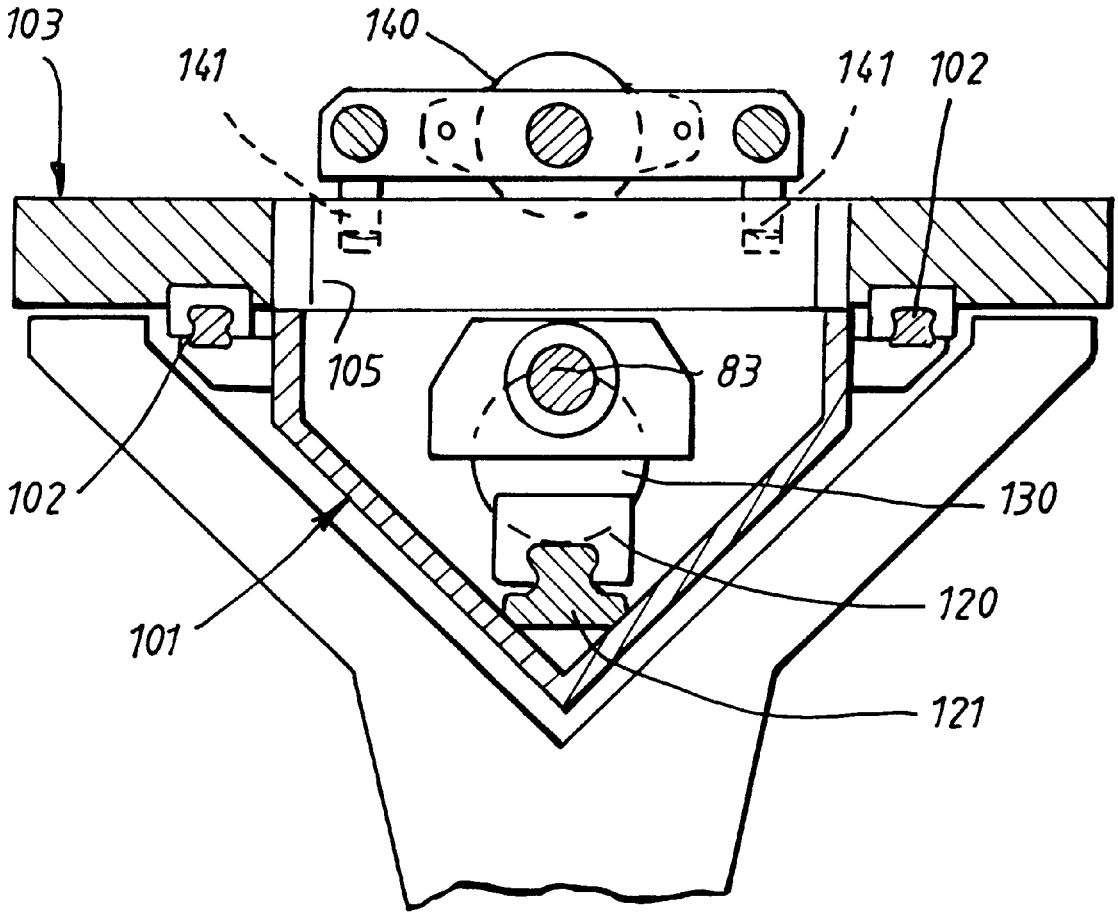
FIG. 6 is a transverse cross section through the certain components of the caster shown in FIGS. 3 to 5.

The illustrated caster comprises a main machine frame 11 which supports a casting roll module in the form of a cassette 13 which can be moved into an operative position in the caster as a unit but can readily be removed when the rolls are to be replaced. Cassette 13 carries a pair of parallel casting rolls 16 to which molten metal is supplied during a casting operation from a ladle (not shown) via a tundish 17, distributor 18 and delivery nozzle 19 to create a casting pool 30. Casting rolls 16 are water cooled so that shells solidify on the moving roll surfaces and are brought together at the nip between them to produce a solidified strip product 20 at the roll outlet. This product may be fed to a standard coiler.

Casting rolls 16 are contra-rotated through drive shafts 41 from an electric motor (not shown) connected to a transmission mounted on the main machine frame. The drive shafts can be disconnected from the transmission when the cassette is to be removed. Rolls 16 have copper peripheral walls formed with a series of longitudinally extending and circumferentially spaced water cooling passages supplied with cooling water through the roll ends from water supply ducts in the roll drive shafts 41 which are connected to water supply hoses 42 through rotary glands 43. The roll may typically be about 500 mm diameter and up to 2000 mm long in order to produce strip product approximately the width of the rolls.

The ladle is of entirely conventional construction and is supported on a rotating turret whence it can be brought into position over the tundish 17 to fill the tundish. The tundish may be fitted with a sliding gate valve 47 actuable by a servo cylinder to allow molten metal to flow from the tundish 17 through the valve 47 and refractory shroud 48 into the distributor 18.

The distributor 18 is also of conventional construction. It is formed as a wide dish made of a refractory material such as magnesium oxide (MgO). One side of the distributor 18 receives molten metal from the tundish 17 and the other side of the distributor 18 is provided with a series of longitudinally spaced metal outlet openings. The lower part of the distributor 18 carries mounting brackets 53 for mounting the distributor onto the main caster frame 11 when it is installed in its operative position.

Delivery nozzle 19 is formed as two identical halves arranged end to end to form an open topped elongate trough. Each half nozzle is formed as an elongate body made of a refractory material such as alumina graphite. The lower part of the nozzle is tapered so as to converge inwardly and downwardly so that it can project into the nip between casting rolls 16. Its upper part is formed with outwardly projecting side flanges 55 which locate on nozzle supports in the manner to be described below.

Nozzle 19 may have a series of horizontally spaced generally vertically extending flow passages to produce a suitably low velocity discharge of metal throughout the width of the rolls and to deliver the molten metal into the nip between the rolls without direct impingement on the roll surfaces at which initial solidification occurs. Alternatively, the nozzle may have a single continuous slot outlet to deliver a low velocity curtain of molten metal directly into the nip between the rolls and/or it may be immersed in the molten metal pool.

The pool is confined at the ends of the rolls by a pair of side closure plates 56 which are held against stepped ends of the rolls when the roll cassette is in its operative position. Side closure plates 56 are made of a strong refractory material, for example boron nitride, and have scalloped side edges to match the curvature of the stepped ends of the rolls. The side plates are mounted in plate holders 82 which are movable by actuation of a pair of thruster 83 to bring the side plates into engagement with the stepped ends of the casting rolls to form end closures for the molten pool of metal formed on the casting rolls during a casting operation.

During a casting operation the sliding gate valve 47 is actuated to allow molten metal to pour from the tundish 17 to the distributor 18 and through the metal delivery nozzle 19 whence it flows onto the casting rolls. The head end of the strip product 20 is guided by actuation of an apron table 96 to the jaws of a coiler (not shown). Apron table 96 hangs from pivot mountings 97 on the main frame and can be swung toward the coiler by actuation of an hydraulic cylinder unit (not shown) after the clean head end has been formed.

Removable roll cassette 13 may be constructed in the manner described in our Australian Patent Application 84244/98 so that the casting rolls 16 can be set up and the nip between them adjusted before the cassette is installed in position in the caster. Details of the cassette construction, which are fully described in patent application 84244/98, form no part of the present invention and need no further description in this context.

In accordance with the present invention the pool confining side plates 56 and thrusters 83 are mounted on a pair of carriages denoted generally as 101 disposed one at each end of the roll assembly and moveable toward and away from one another to enable the spacing between them to be adjusted. The carriages can thus be preset before a casting operation to suit the width of the casting rolls and to allow quick roll changes for differing strip widths. Carriages 101 are hung from linear tracks 102 on the under side of a fixed rectangular plate frame 103 which is mounted on the main machine frame by clamps 104 so as to extend horizontally above the casting rolls and to extend beyond them at the two ends of the caster. Rectangular plate frame 103 is disposed beneath the metal distributor vessel 18 and has a central rectangular opening 105 to receive the metal delivery nozzle 19. The mid part of frame 103 is provided with inwardly projecting delivery nozzle supports 106 to engage upper flanges at the inner ends of the two delivery nozzle half pieces 19A and 19B, whereas the outer ends of the delivery nozzle pieces are supported on nozzle support pins 107 mounted on the inner ends of the two carriages 101 so as to project inwardly of the rectangular fixed frame opening 105 but to be move able in and out with the carriages 101.

Side plates in holders 82 are pivotally connected to the thrusters 83 so that the side plates can tilt about the pivot connections and the thrusters apply opposing forces through the pivots. The pivot connections are provided in such a way that each side plate can rock longitudinally of the rolls by pivoting movement about a horizontal pivot axis transverse to the rolls and can rock laterally of the rolls by pivoting movement about a vertical pivot axis perpendicular to the horizontal pivot axis, the pivoting movement of the plates being confined to movements about those two specific axes so that planar rotation of the plates is prevented.

Side plate holders 82 are pivotally connected by a horizontal pivot pins 126 and a pair of vertical pivot pins 128 to a thruster body 129 at the end of a thruster rod 130 of the respective thruster 83. Thruster rod 130 is supported by a pair of linear bearings 120 on a track 121 on the carriage. The vertical pivot pins 128 are fixed to thruster body 129 and fit into elongate slots in the plate holder. The slots are elongate in the direction longitudinal to the thruster 83 to leave small clearance gaps about the pivot pins 128 which permit limited rocking movement of the plate holder about horizontal pin 126 longitudinally of the rolls.

Horizontal pivot pin 126 is also mounted on the thruster body 129 and engages an internally convex bearing in the plate holder so that the plate holder 82 can rock laterally of the casting rolls about the vertical axis defined by the pivot pins 128. The degree to which the plate holder is free to rock in this manner may be limited by engagement with stops on the thruster body 129.

The horizontal pivot pins 126 are located at such a height above the level of the nip between the casting rolls that the effect of the outward pressure on the side plates due to the molten metal in the casting pool is such as to rotationally bias the side plates about the pivots in such directions that their bottom ends are biased inwardly so as to produce increased sealing pressure at the bottom of the casting pool. The arrangement permits tilting of the side plates so as to accommodate deformation of the casting roll end surfaces due to thermal expansion during casting and at the same time maintains a biasing action which increases the sealing forces at the bottom of the pool so as to counter-act the increased ferrostatic pressure at the bottom of the pool where there is accordingly the greatest tendency for leakage.

Appropriate positioning of the pivots will depend on the diameter of the casting rolls, the height of the casting pool and thickness of the strip being cast. The manner in which correct positioning of the pivots can be determined is fully described in our Australian Patent 693256 and U.S. Pat. No. 5,588,479.

Carriages 101 can be moved along the linear tracks 102 on frame 103 by operation of a pair of fluid operated carriage positioning cylinder units 140, which may be pneumatically or hydraulically operated, fixed by studs 141 to the carriages 101 and acting against fixed abutments 142 on the main machine frame. Cylinder units 140 have two fixed positions so that they can set the carriages in two alternative positions for two different cast strip widths. The setting of the carriages in this way then automatically sets the plate holders in appropriate positions so as to be brought into engagement and firmly pressed against the ends of the casting rolls by operation of the thrusters 83. At the same time, the setting of the carriages moves the outer delivery nozzle support pins 107 into positions to support outer ends of the core nozzle 19 appropriate to the width of the strip to be cast, since the relative positioning of the core nozzle supports and the plate holders is maintained.

Carriages 101 also carry inner bridges 143 which seal against the outer ends of the distribution vessel 18 via seals 144. The bridges 143 are located directly above the side plate holders 82 and will thus fit against the outer ends of the distribution vessel of appropriate width chosen for the size of the strip to be cast thereby to provide a sealed enclosure above the casting pool to enable casting in an inert atmosphere. One or both bridges 143 may also serve as camera supports to support casting pool observation cameras to monitor the condition of the casting pool during casting. Specifically, each bridge may have bores or other mounting means to mount inwardly and downwardly extending camera housings 145.

With the above construction movement of the carriages is effective to set not only the position of the side dams appropriate to the width of the strip to be cast, but also automatically positions the bridges 143 with the casting pool seals 144 and the casting pool observation cameras without the need for individual adjustment or setting of any of these components.

What is claimed is:

1. Apparatus for continuously casting metal strip comprising a pair of parallel casting rolls forming a nip between them; metal delivery means to deliver molten metal into the nip between the rolls to form a casting pool of molten metal supported on casting roll surfaces immediately above the nip; a pair of pool side plates to engage end surfaces of the rolls whereby to form side confining closures for the casting pool; a pair of side plate holders to hold the side plates; a pair of generally horizontally acting thrusters connected to the side plate holders and actuable to apply opposing inward closure forces to the side plates; and roll drive means to drive the casting rolls in counter-rotational directions to produce a solidified strip of metal delivered downwardly from the nip; wherein the thrusters are mounted on a pair of carriages disposed one at each end of the casting roll assembly and moveable toward and away from one another to enable the spacing between them to be adjusted so that the carriages can be preset before a casting operation to suit the width of the casting rolls and to allow them to serve as reaction abutments against which the thrusters react to apply the inward closure forces to the side plates and wherein further both carriages are mounted on a central frame structure which sits over the casting rolls.

2. Apparatus as claimed in claim 1, wherein the metal delivery means comprises an elongate metal delivery nozzle disposed immediately above the nip and a metal distribution vessel to distribute metal into the nozzle.

3. Apparatus as claimed in claim 2, wherein the metal delivery nozzle is composed of two or more pieces disposed end to end.

4. Apparatus as claimed in claim 2, wherein the frame structure comprises a rectangular frame disposed above and extending along the nip, the rectangular frame encompassing a central opening to receive the nozzle.

5. Apparatus as claimed in claim 2, wherein the frame structure provides a central nozzle locating support for the metal delivery nozzle.

6. Apparatus as claimed in claim 1, wherein the carriages are moveable on linear tracks on said frame structure.

7. Apparatus as claimed in claim 6, wherein the carriages are hung from said linear tracks beneath the frame structure.

8. Apparatus as claimed in claim 1, wherein there is a carriage drive means acting between the frame structure and the carriages to move the carriages toward and away from one another.

9. Apparatus as claimed in claim 8, wherein the carriage drive means comprises a pair of fluid operated cylinder units connected one to each of the carriages.

10. Apparatus as claimed in claim 8, wherein the carriage drive means is operable to set the carriages at any one of a plurality of preset spacings in which they are set generally equidistant from a central part of the frame structure.

11. Apparatus as claimed in claim 5, wherein there is a carriage drive means acting between the frame structure and the carriages to move the carriages toward and away from one another and operable to set the carriages at any one of a plurality of preset spacings in which they are set generally equidistant from the central nozzle locating support.

12. Apparatus as claimed in claim 11, wherein the carriages are provided with nozzle outer end supports to support outer ends of the nozzle at locations the spacing of which is determined by the preset spacing of the carriages.

13. Apparatus as claimed in claim 12, wherein the nozzle outer end supports are mounted on the carriages so as to be equidistant from the centre nozzle locating support when the carriages are in any of their preset spacings.

14. Apparatus as claimed in claim 11, wherein the carriages are moveable on linear tracks on said frame structure.

15. Apparatus as claimed in claim 14, wherein the carriages are hung from said linear tracks beneath the frame structure.

16. Apparatus as claimed in claim 11, wherein the carriage drive means comprises a pair of fluid operated cylinder units connected one to each of the carriages.

17. Apparatus as claimed in claim 1, wherein the carriages are provided with sealing means to engage the metal delivery means so as to provide a sealed casting pool chamber above the casting pool.

18. Apparatus as claimed in claim 2, wherein the carriages are provided with sealing means which engage end parts of the distribution vessel so as to provide a sealed casting pool chamber above the casting pool.

19. Apparatus as claimed in claim 18, wherein the sealing means comprises pool closure members carried on said carriages above the side plate holders and fitted with seals to engage said end parts of the distribution vessel.

20. Apparatus as claimed in claim 1, wherein at least one of the carriages is provided with a camera mounting for mounting a camera to observe the casting pool during casting.

21. Apparatus as claimed in claim 20, wherein the camera mounting is located on said one carriage above the respective side dam structure.

* * * * *